US007926130B2

(12) United States Patent
Nagano et al.

(10) Patent No.: US 7,926,130 B2
(45) Date of Patent: Apr. 19, 2011

(54) FOLDABLE SIDE RAIL

(75) Inventors: Yutaka Nagano, Tokyo (JP); Taichiro Sato, Tokyo (JP); Eita Hirai, Tokyo (JP)

(73) Assignee: Paramount Bed Co., Ltd., Tokyo (JP)

( * ) Notice: Subject to any disclaimer, the term of this patent is extended or adjusted under 35 U.S.C. 154(b) by 0 days.

(21) Appl. No.: 12/742,142

(22) PCT Filed: Aug. 26, 2008

(86) PCT No.: PCT/JP2008/065197

§ 371 (c)(1),
(2), (4) Date: Aug. 24, 2010

(87) PCT Pub. No.: WO2009/063671

PCT Pub. Date: May 22, 2009

(65) Prior Publication Data

US 2010/0306918 A1 Dec. 9, 2010

(30) Foreign Application Priority Data

Nov. 13, 2007 (JP) ..... 2007-294959

(51) Int. Cl.
*A47C 21/08* (2006.01)

(52) U.S. Cl. ..... 5/430; 5/428

(58) Field of Classification Search ..... 5/425, 428, 5/430

See application file for complete search history.

(56) References Cited

U.S. PATENT DOCUMENTS 2,976,548 A * 3/1961 Maertins ..... 5/430
3,195,153 A * 7/1965 Armstrong et al. ..... 5/430
3,526,008 A * 9/1970 Pruim ..... 5/430
3,865,434 A * 2/1975 Sully ..... 297/411.33

(Continued)

FOREIGN PATENT DOCUMENTS

JP 2697765 9/1997

(Continued)

OTHER PUBLICATIONS

International Search Report issued Dec. 9, 2008 in International (PCT) Application No. PCT/JP2008/065197.

*Primary Examiner* — Michael Trettel

(74) *Attorney, Agent, or Firm* — Wenderoth, Lind & Ponack, L.L.P.

(57) ABSTRACT

In the conventional holding mechanism for supporting strut members in a state just before the stowed state is reached, reliable operation is difficult.

This invention proposes a foldable side rail comprising multiple strut members 2 pivotally rotatably connected between an upper crosspiece member 1*u* and a lower crosspiece member 1*d*, to form a parallel link mechanism, in such a manner that the side rail can be operated between a deployed state for use where the strut members are kept upright and a stowed state of disuse where the strut members are laid down, wherein a first holding mechanism 5 is provided for holding said strut members in an upright position; and second holding mechanisms 6 are provided on the lower crosspiece member for supporting the strut members in a state just before the abovementioned stowed state is reached, each of the second holding mechanisms consisting of a holding piece pivotally rotatable between a holding position and a non-holding position, a spring for urging the holding piece toward the holding position, a locking mechanism for locking the holding piece in the non-holding position, and an unlocking mechanism.

2 Claims, 6 Drawing Sheets

U.S. PATENT DOCUMENTS

| | | | | |
|---|---|---|---|---|
| 5,187,824 | A * | 2/1993 | Stryker | 5/430 |
| 5,802,636 | A * | 9/1998 | Corbin et al. | 5/425 |
| 6,360,385 | B1 * | 3/2002 | Lewandowski | 5/430 |
| 6,640,361 | B2 * | 11/2003 | Heimbrock et al. | 5/430 |
| 2008/0010745 | A1 * | 1/2008 | Giesser | 5/430 |

FOREIGN PATENT DOCUMENTS

| | | |
|---|---|---|
| JP | 2005-58513 | 3/2005 |
| JP | 2006-296611 | 11/2006 |

* cited by examiner

FOLDABLE SIDE RAIL

TECHNICAL FIELD

The present invention relates to a foldable side rail for a bed or the like, particularly a foldable side rail in which multiple strut members are pivotally rotatably connected between an upper crosspiece member and a lower crosspiece member to form a parallel link mechanism.

BACKGROUND ART

Various side rails for beds have been proposed hitherto. Among them, widely used are foldable side rails, each comprising multiple strut members pivotally rotatably connected between an upper crosspiece member and a lower crosspiece member, to form a parallel link mechanism, in such a manner that the side rail can assume a deployed state for use where the abovementioned strut members are held in an upright position and a stowed state of disuse where the strut members are laid down to lower the upper crosspiece member in parallel. The upper crosspiece member of such a foldable side rail is desired to be kept as low as possible in height in the stowed state of disuse, lest the upper crosspiece member should interfere when the person lying on the bed leaves from the bed or when a care giver extends assistance to the care receiver on the bed. To meet this requirement, it is only required that there are no clearances at all or there are the smallest possible clearances formed between the multiple strut members overlapping one after another in the stowed state.

However, if an operator (user) or a third party puts his/her finger between the strut members unconsciously for folding the side rail into the stowed state, or if an operator (user) or a third party applies a load to the upper crosspiece member while another person puts his/her finger between a clearance formed due to any foreign matter such as a mattress held between the strut members in the stowed state, the finger can be caught between the strut members very dangerously.

To avoid such a danger, for example, Patent Document 1 proposes a constitution in which when a side rail is folded to a state just before the stowed state is reached, holding pieces installed on the lower crosspiece member hold the strut members for preventing the strut members from being further laid down and remain urged toward the holding position by springs.

In this constitution, when the strut members have been laid to a state just before the stowed state is reached, the strut members are brought into contact with and supported by the holding pieces kept in the holding position by the springs, and since spaces with a predetermined width still remain to be formed between the respective strut members at this position, no finger can be caught between the strut members.

After the strut members are once held at the holding position, the holding pieces can be further pivotally rotated against the urging of the springs, to leave the strut members supported in a non-holding position by a person, and thus since the strut members can now be pivotally rotated again, the strut members can be further laid down to the stowed state.

Patent Document 1: Japanese Patent 2697765

DISCLOSURE OF THE INVENTION

Problem to be Solved by the Invention

As the holding pieces described in the abovementioned Patent Document 1, at least two or more holding pieces are required to be installed in view of strength, and in this case, it is difficult for one person to fold the side rail while supporting the holding pieces in the non-holding position. If three or more holding pieces are installed, it is impossible for one person to perform this work.

The object of this invention is to solve the abovementioned problem.

Means for Solving the Problem

To solve the abovementioned problem, the present invention proposes a foldable side rail comprising multiple strut members pivotally rotatably connected between an upper crosspiece member and a lower crosspiece member, to form a parallel link mechanism, in such a manner that the side rail can be operated between a deployed state for use where the strut members are kept upright and a stowed state of disuse where the strut members are laid down, wherein a first holding mechanism is provided for holding said strut members in an upright position; and second holding mechanisms are provided on the lower crosspiece member for supporting the strut members in a state just before the abovementioned stowed state is reached, each of the second holding mechanisms consisting of a holding piece pivotally rotatable between a holding position and a non-holding position, a spring for urging the holding piece toward the holding position, a locking mechanism for locking the holding piece in the non-holding position, and an unlocking mechanism.

Further, the present invention proposes the abovementioned constitution, wherein the holding piece is supported pivotally rotatably adjacently to one of the strut members; and the holding piece and the corresponding strut member are provided with one each first engagement projection in such a manner that both the first engagement projections can be engaged with each other when the holding piece is in the holding position, for preventing the pivotal rotation toward the non-holding position and with one each second engagement projection in such a manner that both the second engagement projections can be engaged with each other when the holding piece is in the non-holding position, for preventing the pivotal rotation toward the holding position; and the corresponding strut member is provided with a third engagement projection to be engaged with the second engagement projection of the holding piece when the strut member is pivotally rotated toward being upright, for releasing the engagement between the second engagement projections.

Effects of the Invention

At first, in the foldable side rail of claim 1, in the operation for stowing, in a state just before the strut members reach the stowed state, the strut members can be temporarily held by the holding pieces constituting the second holding mechanisms, and since the holding pieces can be locked in the non-holding position by the locking mechanisms, the strut members can be further laid down to the stowed state while a human hand is kept away from the holding pieces.

For this reason, two or more holding pieces can be installed to obviate the problem of strength, and the operation for reaching the stowed state is easy.

In the foldable side rail of claim 2, during the pivotal rotation of the strut members toward being upright, the locking mechanisms for locking the holding pieces in the non-holding position can be released. Therefore, the holding pieces can always be kept in the holding position at the next time of stowing, and any inconvenience due to forgotten release cannot happen.

MEANINGS OF SYMBOLS

Figure 1:
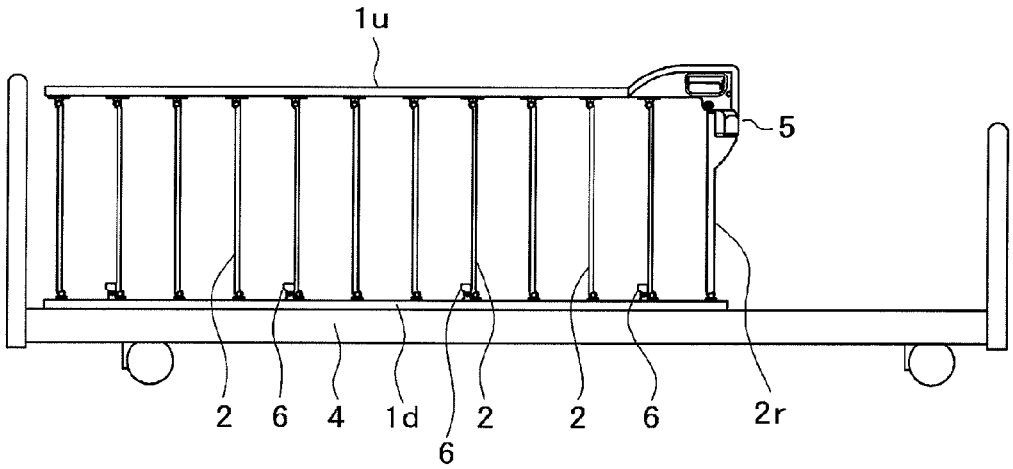
FIG. 1 is an illustration showing a first embodiment of the foldable side rail of this invention in the deployed state for use.

1*u* upper crosspiece member
1*d* lower crosspiece member
2 strut member
3 attaching rod
4 bed
5 first holding mechanism
6 second holding mechanism
7 holding piece
8 support member
9 spring (torsion spring)
10*a*, 10*b* first engagement portion
11*a*, 11*b* second engagement portion
12 third engagement portion

THE BEST MODES FOR CARRYING OUT THE INVENTION

An embodiment of the foldable side rail of this invention is explained below in reference to the attached drawings.

At first, FIGS. 1 through 11 show a first embodiment of the foldable side rail to which the present invention is applied. FIGS. 1 through 4 generally show the constitution and action of the foldable side rail of this invention. Further, FIGS. 5 through 11 illustrate the constitution and action of major portions.

In FIGS. 1 through 4, symbol 1*u* denotes an upper crosspiece member and 1*d* denotes a lower crosspiece member. Multiple strut members 2, twelve strut members 2 in this case, are connected pivotally rotatably between the upper crosspiece member 1*u* and the lower crosspiece member 1*d*, to form a parallel link mechanism.

Figure 3:
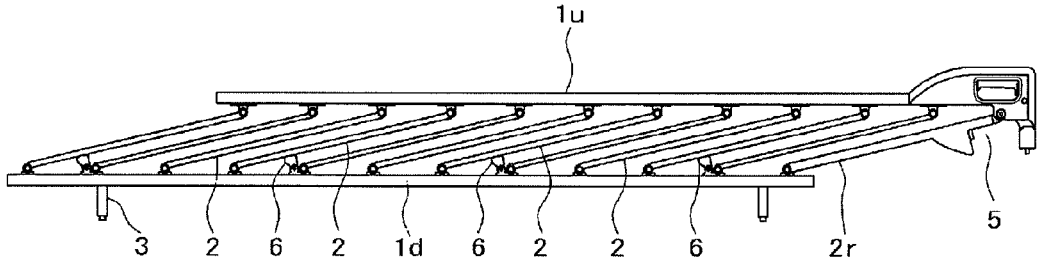
FIG. 3 is an illustration showing the first embodiment of the foldable side rail of this invention in a temporarily suspended state just before the stowed state is reached.
Figure 4:
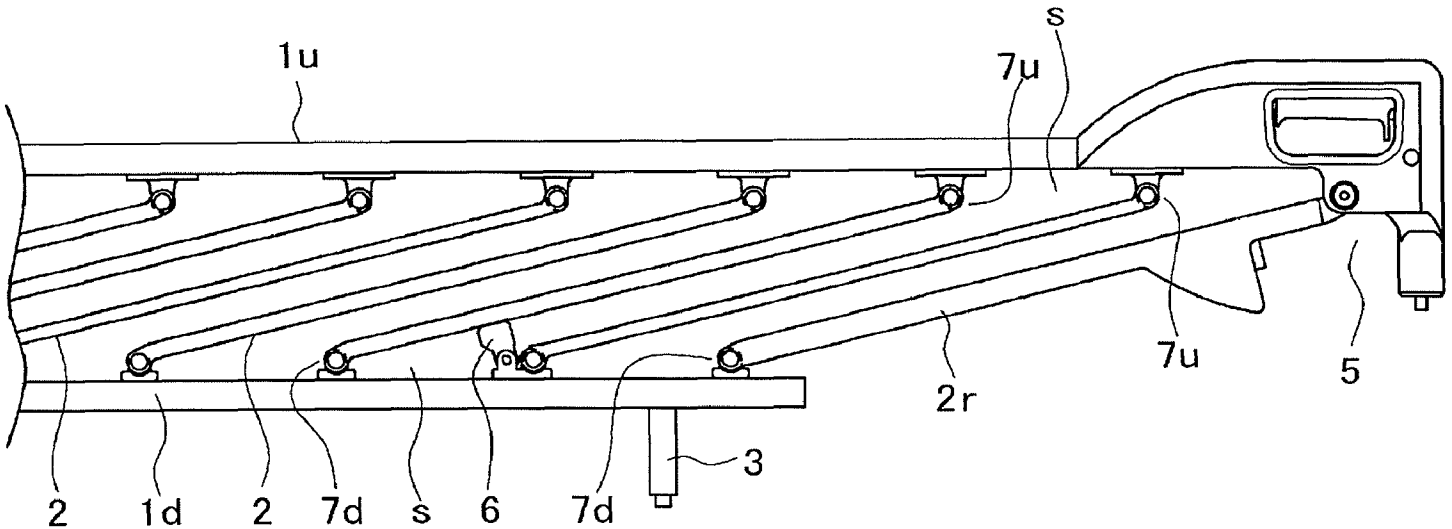
FIG. 4 is an expanded view showing a major portion of FIG. 3.

In FIGS. 3 and 4, symbol 3 denotes an attaching rod projected below the lower crosspiece member 1*d*. The attaching rods 3 are fitted into the fitting holes formed in the upper surface of a bed frame, to attach the side rail to a lateral side of the bed 4. Further, symbol 5 denotes a holding mechanism for holding the strut members 2 in an upright position, that is, for keeping the side rail in the deployed state. The holding mechanism 5 is the abovementioned first holding mechanism, and the first holding mechanism 5 has a mechanism as described, for example, in the abovementioned Patent Document 1 and Patent Document 2.

On the other hand, the lower crosspiece member 1*d* is provided with mechanisms for supporting the strut members 2 in a state just before the stowed state is reached, that is, the abovementioned second holding mechanisms 6. The detail of each of the holding mechanisms 6 is described below.

Figure 7:
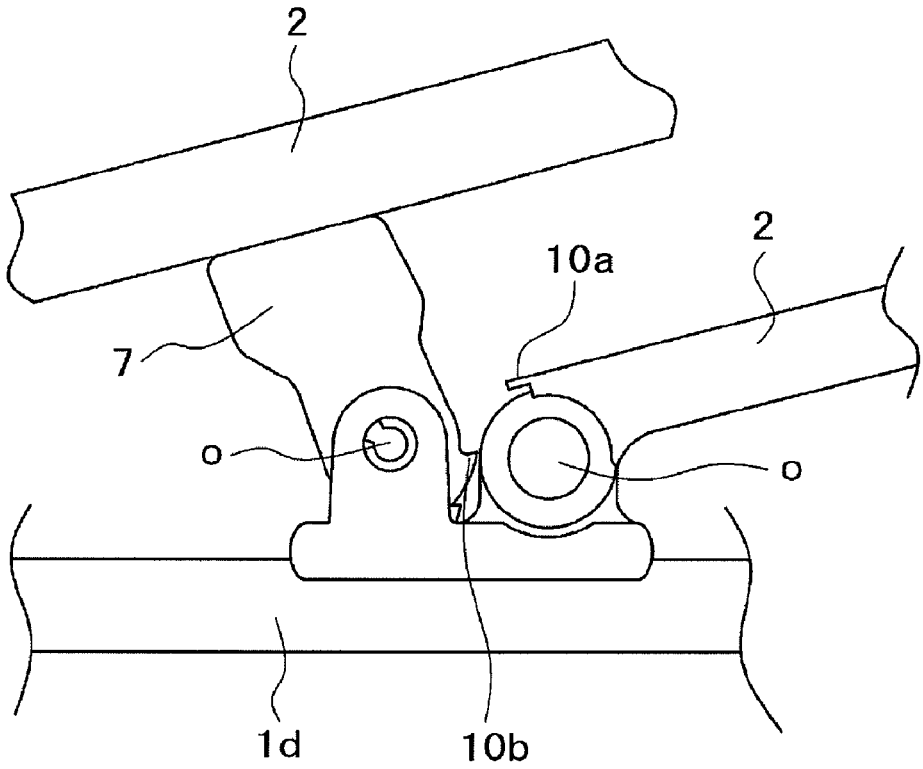
FIG. 7 is a side view showing the constitution and action of a major portion in the first embodiment of the foldable side rail of this invention in another phase.
Figure 9:
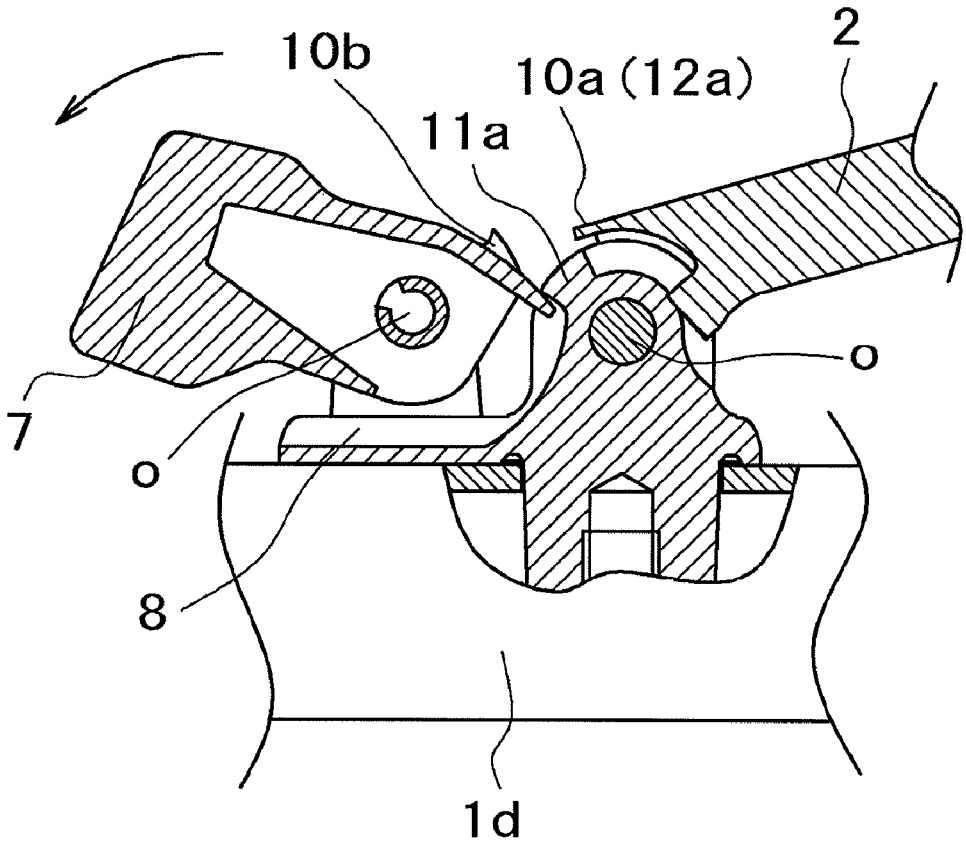
FIG. 9 is a sectional view showing the constitution and action of a major portion in the first embodiment of the foldable side rail of this invention in a further other phase.
Figure 10:
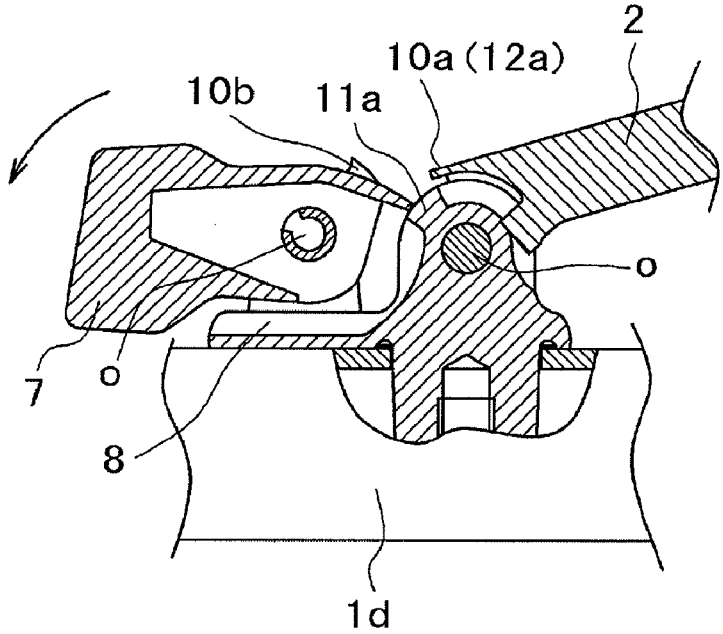
FIG. 10 is a sectional view showing the constitution and action of a major portion in the first embodiment of the foldable side rail of this invention in a further other phase.
Figure 11:
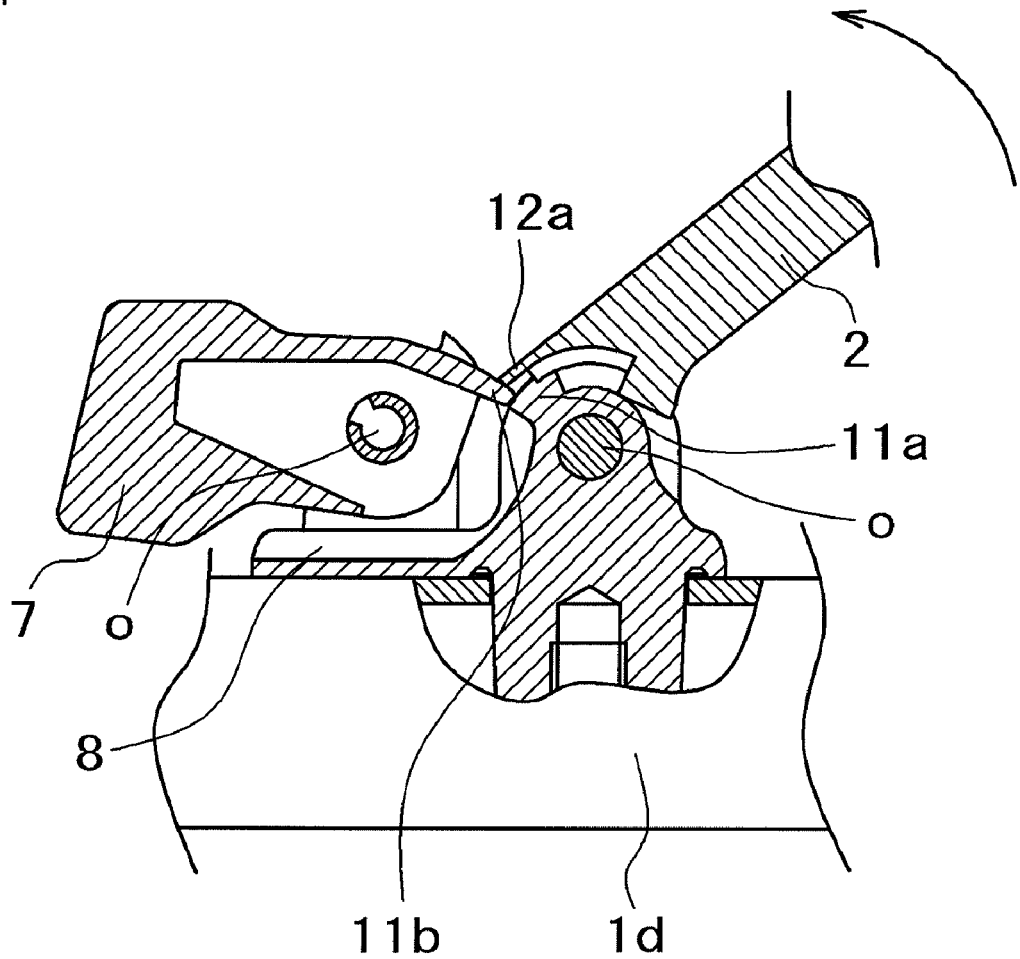
FIG. 11 is a sectional view showing the constitution and action of a major portion in the first embodiment of the foldable side rail of this invention in a further other phase.

Symbol 7 denotes a holding piece, and the holding piece 7 is supported pivotally rotatably adjacently to one of the strut members 2 and can be pivotally rotated between the holding position in which the strut members are held in the upright position and the non-holding position in which the strut members are laid down. Symbol 8 denotes a support member for pivotally rotatably supporting the holding piece 7 and the corresponding strut member 2 on the lower crosspiece member 1*d*. The holding piece 7 is urged toward the holding position, namely, clockwise in the drawings by a spring 9, a torsion spring in this case. Meanwhile, the holding position means a position in which the strut members can be held, and does not mean the particular position in which the strut members held are slightly inclined as shown in FIG. 3, 4 or 7. In FIGS. 9 through 11, the spring 9 is not depicted.

Furthermore, the holding piece 7 and the corresponding strut member 2 are provided with one each first engagement projection 10*b* or 10*a* in such a manner that both the first engagement projections 10*b* and 10*a* can be engaged with each other when the holding piece 7 is in the holding position, for preventing the pivotal rotation toward the non-holding position and with one each second engagement projection 11*b* or 11*a* in such a manner that both the second engagement projections 11*b* and 11*a* can be engaged with each other when the holding piece 7 is in the non-holding position, for preventing the pivotal rotation toward the holding position. Moreover, the corresponding strut member 2 is provided with a third engagement projection 12*a* to be engaged with the second engagement projection 11*b* of the holding piece 7 when the strut member is pivotally rotated toward being upright, for releasing the engagement between the second engagement projections 11*b* and 11*a*. As stated here, the first, second and third engagement projections of the strut member 2 are expressed by subscript a, and those of the holding piece 7 are expressed by subscript b.

Figure 5:
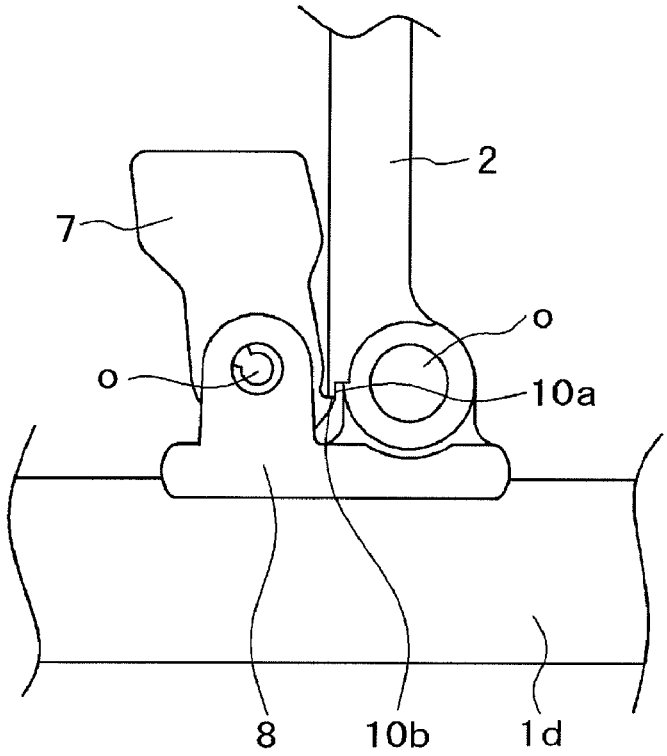
FIG. 5 is a side view showing the constitution and action of a major portion in the first embodiment of the foldable side rail of this invention.
Figure 6:
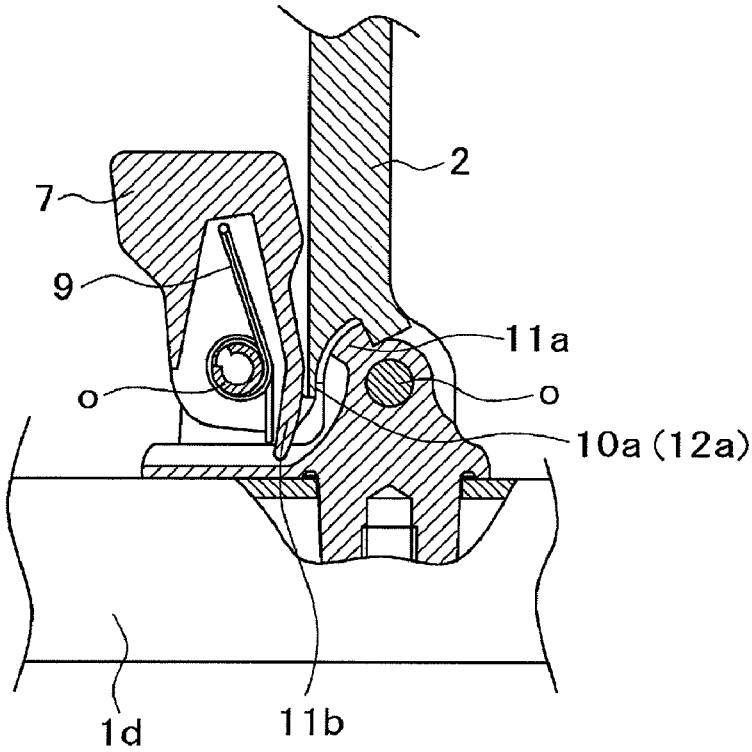
FIG. 6 is a sectional view showing the constitution and action of a major portion in the first embodiment of the foldable side rail of this invention.

In the above constitution, in the case where the strut member 2 is kept upright as shown in FIGS. 5 and 6, since the first engagement projections 10*a* and 10*b* are engaged with each other, the holding piece 7 cannot be pivotally rotated counterclockwise in the drawings.

Then, if the holding of the first holding mechanism 5 is released to pivotally rotate the strut members 2 clockwise in the drawings, the strut members 2 are gradually laid down, and the strut member 2 concerned contacts the holding piece 7 kept upright by the urging of the spring 9. The strut member 2 concerned is the strut member 2 adjacent to the holding piece 7 on the left side of the holding piece 7 in the drawings, not the adjacent strut member 2 on the right side. Thus, the holding piece 7 is slightly inclined in response to the inclination angle of the strut member 2 concerned to support the strut member 2 concerned as shown in FIG. 3, 4 or 7. In this state, since spaces to allow free insertion of a finger are formed between the respective strut members 2 adjacent to each other, it does not happen that the finger is caught.

Figure 8:
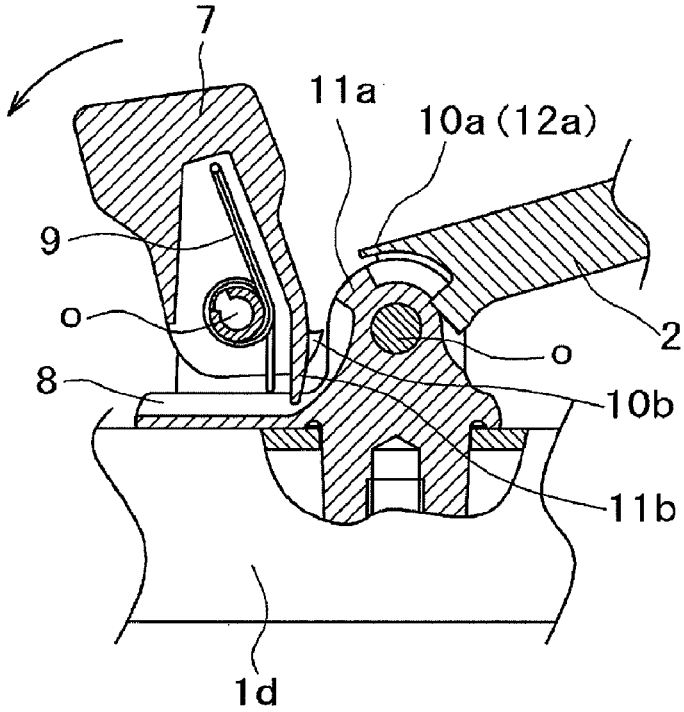
FIG. 8 is a sectional view showing the constitution and action of a major portion in the first embodiment of the foldable side rail of this invention in a further other phase.

Subsequently in order to let the foldable side rail perfectly reach the stowed state, at first, the upper crosspiece member 1*u* is slightly raised for allowing the holding piece 7 to be pivotally rotated, and in this state, as shown in FIG. 8, the holding piece 7 is pivotally rotated counterclockwise against the urging of the spring 9.

If the holding piece 7 is pivotally rotated counterclockwise as described above, as shown in FIG. 9, the second engagement projection 11*b* of the holding piece 7 contacts the corresponding lateral side at the edge of the second engagement projection 11*a* of the strut member 2. If the holding piece 7 is further pivotally rotated counterclockwise at this moment, the second engagement projection 11*b* is elastically deformed and climbs the lateral side to reach the top of the second engagement projection 11*a*, and as shown in FIG. 10, the second engagement projections 11*a* and 11*b* are engaged with each other.

If the second engagement projections 11*a* and 11*b* are engaged with each other as shown in FIG. 10, the holding piece 7 cannot be pivotally rotated clockwise even if it is urged by the spring 9, and is kept in the non-holding position.

Figure 2:
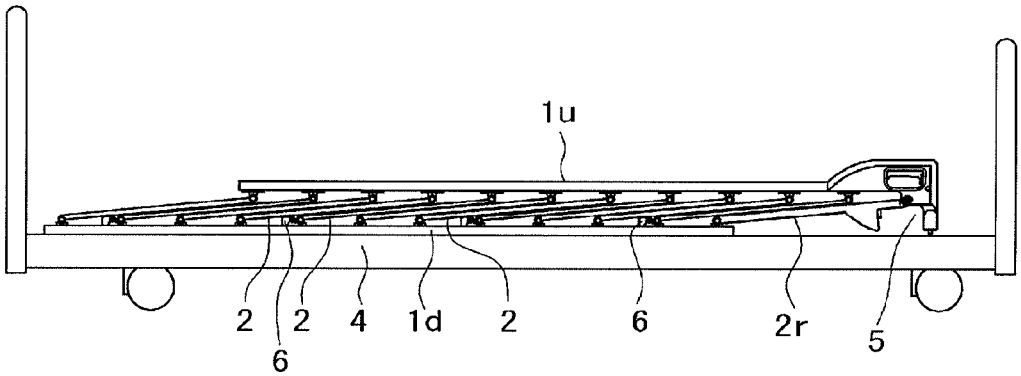
FIG. 2 is an illustration showing the first embodiment of the foldable side rail of this invention in the stowed state of disuse.

Thus, the strut members 2 can be further pivotally rotated to be laid down, and the foldable side rail can be perfectly folded into the stowed state as shown in FIG. 2. In this stowed state, the clearances between the respectively adjacent strut members 2 are minimum and the upper crosspiece member 1*u* can be kept low in height.

Then in order to unfold the foldable side rail from the stowed state to the deployed state, the strut members 2 are pivotally rotated counterclockwise. As a result, the third engagement projection 12*a* of the corresponding strut member 2 contacts the second engagement projection 11*b* as shown in FIG. 11, and if the strut member 2 is further pivotally rotated counterclockwise, the second engagement projection 11*b* is pressed and disengaged from the top of the second engagement projection 11*a*.

In this state, the holding piece 7 can be again pivotally rotated clockwise and is pivotally rotated by the urging of the spring 9, to reach the upright position shown in FIG. 6.

As described above, in this embodiment, since the locking mechanism for locking the holding piece 7 in the non-holding position can be released when the strut members 2 are pivotally rotated toward being upright, the holding piece 7 can be always kept in the holding position at the next time of stowing, and any inconvenience due to forgotten release cannot happen.

INDUSTRIAL APPLICABILITY

The foldable side rail of this invention as described above has such advantages that the strut members can be reliably held by using multiple holding pieces of holding mechanisms in a state just before the stowed state is reached, and that the locking operation to lock those multiple holding pieces in the non-holding position can be easily and reliably performed by only one person.

Further, in this invention, since the locking mechanisms for locking the holding pieces in the non-holding position can be automatically released when the strut members are pivotally rotated toward being upright, the holding pieces can be always kept in the holding position at the next time of stowing, and any inconvenience due to forgotten release cannot happen.

The foldable side rail of this invention can be used not only for medical beds but also for home care beds and general beds.

The invention claimed is:

1. A foldable side rail comprising multiple strut members pivotally rotatably connected between an upper crosspiece member and a lower crosspiece member, to form a parallel link mechanism, in such a manner that the side rail can be operated between a deployed state for use where the strut members are kept upright and a stowed state of disuse where the strut members are laid down, wherein a first holding mechanism is provided for holding said strut members in the upright position; and second holding mechanisms are provided on the lower crosspiece member for supporting the strut members in a state just before the abovementioned stowed state is reached, each of the second holding mechanisms consisting of a holding piece pivotally rotatable between a holding position and a non-holding position, a spring for urging the holding piece toward the holding position, a locking mechanism for locking the holding piece in the non-holding position, and an unlocking mechanism.

2. A foldable side rail, according to claim 1, wherein the holding piece is supported pivotally rotatably adjacently to one of the strut members; and the holding piece and the corresponding strut member are provided with one each first engagement projection in such a manner that both the first engagement projections can be engaged with each other when the holding piece is in the holding position, for preventing the pivotal rotation toward the non-holding position and with one each second engagement projection in such a manner that both the second engagement projections can be engaged with each other when the holding piece is in the non-holding position, for preventing the pivotal rotation toward the holding position; and the corresponding strut member is provided with a third engagement projection to be engaged with the second engagement projection of the holding piece when the strut member is pivotally rotated toward being upright, for releasing the engagement between the second engagement projections.

* * * * *